US009104133B2

(12) United States Patent
Matsubara et al.

(10) Patent No.: US 9,104,133 B2
(45) Date of Patent: Aug. 11, 2015

(54) TONER IMAGE FORMING DEVICE, AND IMAGE FORMING APPARATUS

(71) Applicant: FUJI XEROX CO., LTD., Tokyo (JP)

(72) Inventors: Takashi Matsubara, Kanagawa (JP); Takeshi Agata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 96 days.

(21) Appl. No.: 13/875,718

(22) Filed: May 2, 2013

(65) Prior Publication Data

US 2014/0099133 A1 Apr. 10, 2014

(30) Foreign Application Priority Data

Oct. 5, 2012 (JP) ..... 2012-223172

(51) Int. Cl.

| | |
|---|---|
| ***G03G 15/00*** | (2006.01) |
| ***G03G 15/08*** | (2006.01) |
| ***G03G 15/01*** | (2006.01) |
| ***G03G 15/20*** | (2006.01) |

(52) U.S. Cl.

CPC ..... *G03G 15/08* (2013.01); *G03G 15/0194* (2013.01); *G03G 15/201* (2013.01); *G03G 2215/2074* (2013.01)

(58) Field of Classification Search

CPC ..... G03G 15/0194; G03G 15/201; G03F 2215/2074

USPC ..... 399/53, 54, 58, 59, 67, 223, 221, 258, 399/260

See application file for complete search history.

(56) References Cited

U.S. PATENT DOCUMENTS

| | | | | |
|---|---|---|---|---|
| 2004/0265714 | A1* | 12/2004 | Miyakawa et al. | 430/45 |
| 2008/0318141 | A1* | 12/2008 | Shin et al. | 430/48 |
| 2009/0180813 | A1* | 7/2009 | Yoneda et al. | 399/258 |
| 2010/0080582 | A1* | 4/2010 | Sato et al. | 399/39 |
| 2012/0045239 | A1* | 2/2012 | Maeda | 399/67 |
| 2012/0087682 | A1* | 4/2012 | Deguchi et al. | 399/43 |
| 2012/0099879 | A1* | 4/2012 | Aslam et al. | 399/53 |

FOREIGN PATENT DOCUMENTS

| | | |
|---|---|---|
| JP | A-2000-181142 | 6/2000 |
| JP | A-2006-78689 | 3/2006 |
| JP | A-2008-89828 | 4/2008 |
| JP | A-2010-230847 | 10/2010 |

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A toner image forming device includes a first toner image forming section including a charged first image holding member, a first exposing unit that emits light onto the first image holding member to form a latent image thereon, and a first developing unit that develops the latent image by a black toner to form a toner image, a second toner image forming section including a charged second image holding member, a second exposing unit that emits light onto the second image holding member to form a latent image thereon, and a second developing unit that develops the latent image by a toner of color other than black to form a toner image, and a controller that performs control so that the number of toners that the second toner image forming section uses is larger than the number of toners that the first toner image forming section uses.

20 Claims, 8 Drawing Sheets

TONER IMAGE FORMING DEVICE, AND IMAGE FORMING APPARATUS

CROSS-REFERENCE TO RELATED APPLICATIONS

This application is based on and claims priority under 35 USC 119 from Japanese Patent Application No. 2012-223172 filed Oct. 5, 2012.

BACKGROUND (i) Technical Field

The present invention relates to a toner image forming device, and an image forming apparatus.

(ii) Related Art

In an electrophotographic image forming apparatus, a toner that forms a toner image formed on a recording sheet is heated and fused to be fixed onto the recording sheet. As a technique used in the fixation, for example, there is a technique in which a flash lamp is disposed to face a transport path of a recording sheet and a toner on the recording sheet being transported is heated and fused as the flash lamp is intermittently turned on. In a fixing device that uses the flash lamp, various techniques for uniformizing fixity of the toner have been proposed.

The fixation that uses the flash lamp has characteristics of general-purpose recording sheets, easy speed-up due to non-contact and the like, as compared with the fixation that uses the heat roller. Further, in recent years, according to cost reduction and output increase of a semiconductor laser, a fixing device has been proposed in which a flash lamp is replaced with a high-power semiconductor laser.

SUMMARY

According to an aspect of the invention, there is provided a toner image forming device including: a first toner image forming section including a charged first image holding member, a first exposing unit that emits light onto the first image holding member to forma latent image on the first image holding member, and a first developing unit that develops the latent image formed on a surface of the first image holding member by a black toner to form a toner image; a second toner image forming section including a charged second image holding member, a second exposing unit that emits light onto the second image holding member to forma latent image on the second image holding member, and a second developing unit that develops the latent image formed on a surface of the second image holding member by a toner of color other than black to form a toner image; and a controller that performs control so that the number of toners that the second toner image forming section uses per unit area with respect to an image signal of a first coverage is larger than the number of toners that the first toner image forming section uses per unit area with respect to the image signal of the first coverage.

BRIEF DESCRIPTION OF THE DRAWINGS

Exemplary embodiments of the present invention will be described in detail based on the following figures, wherein.

DETAILED DESCRIPTION

First Exemplary Embodiment

Configuration

Figure 1:
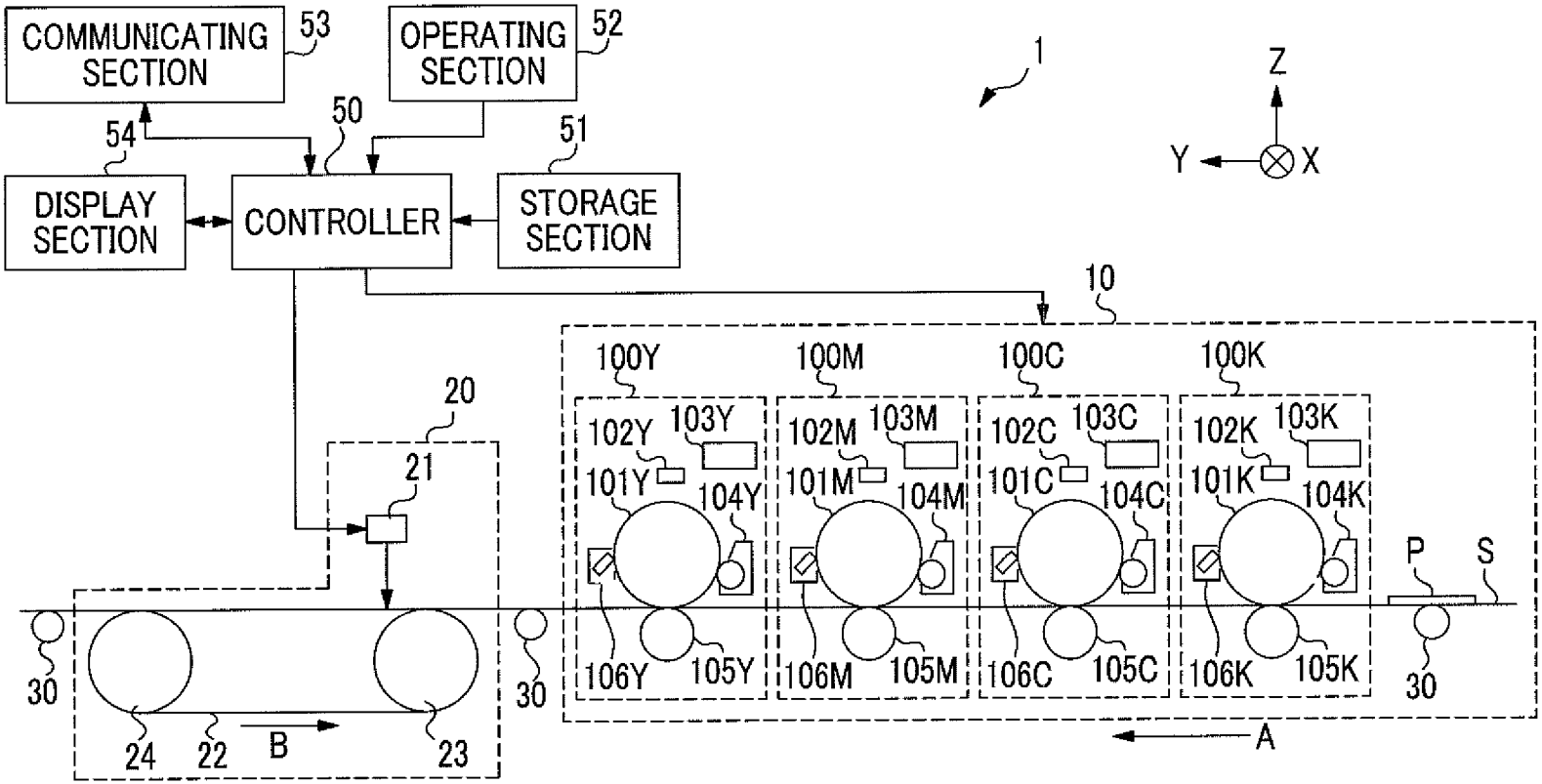
FIG. 1 is a diagram illustrating a configuration of an image forming apparatus.

FIG. 1 is a diagram schematically illustrating a configuration of an image forming apparatus 1 according to an exemplary embodiment of the invention. The image forming apparatus 1 includes an image forming device 10, a fixing device 20 and plural rollers 30. Further, the image forming apparatus 1 includes a controller 50, a storage section 51, an operating section 52, and a communicating section 53, and a display section 54. The image forming apparatus 1 is an apparatus that forms an image on a sheet P that is an example of a recording medium on which an image is formed by electrophotography, and is an example of the image forming apparatus according to the invention. The image forming apparatus 1 forms an image on the sheet P on the basis of image data received from the outside or image data that is stored in advance. The sheet P is a sheet having a predetermined size such as an A type or B type, but the size of the sheet P is not limited to the above-mentioned size. The sheet P may be a continuous paper that is continuous in a transport direction of the sheet P. Further, the material of the sheet P is not limited to a specific material.

The rollers 30 transport the sheet P. The rollers 30 are rotated by a motor (not shown) to send the sheet P in a direction of arrow A along a transport path S, and thus, the sheet P is transported to the image forming device 10 and the fixing device 20. With respect to the transport path S, in the following description, the direction of an arrow A that is a direction where the sheet P is transported is referred to as a downstream, and a direction opposite to the arrow A is referred to as an upstream.

The image forming device 10 (an example of a toner image forming device) forms a toner image for each color on the basis of image data, and transfers the formed toner image onto the sheet P. Thus, the image forming device 10 includes image forming units 100Y, 100M, 100C and 100K for respective colors of yellow (Y), magenta (M), cyan (C) and black (K). The image forming units are sequentially arranged in the order of the image forming unit 100K, the image forming unit 100C, the image forming unit 100M and the image forming unit 100Y from the upstream side in the transport direction. Among the components illustrated in FIG. 1, a component with an alphabet (Y, M, C or K) at the end of a reference numeral represents that the component corresponds to anyone of four colors. Since the respective units are the same in their configurations or functions, except that corresponding colors are: different from each other, the image forming unit 100K will be described as an example, with respect to the configuration of the image forming unit. In the following description, for ease of description, in a case where it is not necessary to distinguish respective photosensitive bodies 101Y, 101M, 101C and 101K, these photosensitive bodies are referred to as a "photosensitive body 101". This is similarly applied to other components included by the respective image forming units 100Y, 100M, 100C and 100K. For example, in a case where it is not necessary to distinguish the respective yellow, magenta, cyan and black, for ease of description, each component is referred with the alphabets of Y, M, C and K being removed (for example, a charging unit 102, an exposing unit 103 or the like). In the following description, for ease of description, in a case where it is not necessary to distinguish respective toners of colors (that is, yellow, magenta and cyan) other than black, these toners are referred to as a "color toner". Further, a developer according to the present exemplary embodiment is a two-ingredient developer that includes a toner of each color and a magnetic carrier such as ferrite powder.

The image forming unit 100K (an example of a first toner image forming section) includes a photosensitive body 101K, a charging unit 102K, an exposing unit 103K, a developing unit 104K, a roller 105K, and a cleaning unit 106K. The photosensitive body 101K is a cylindrical component in which a photoconductive layer is formed on the surface thereof. The photosensitive body 101K (an example of a first image holding member) is rotated by a motor (not shown) to form a toner image on the surface thereof. The photosensitive bodies 101Y, 101M, and 101C are examples of a second image holding member according to the invention. The charging unit 102K charges the surface of the photosensitive body 101K by corona discharge. The exposing unit 103K (an example of a first exposing unit) includes a light source that emits light, and emits the light onto the photosensitive body 101K on the basis of image data to form an electrostatic latent image corresponding to the image data on the photosensitive body 101K. The image forming units 100Y, 100M and 100C are examples of a second toner image forming section according to the invention, and the exposing units 103Y, 103M and 103C are examples of a second exposing unit according to the invention.

The developing unit 104K (an example of a first developing unit) forms (develops) a toner image according to the electrostatic latent image formed on the photosensitive body 101K, and develops the toner image by a toner of black (hereinafter, referred to as a block toner). The developing unit 104K includes a container that contains a black developer. In the container, an agitator that agitates the developer, a rod-shaped member that includes a magnetic body that draws the agitated developer, and a developing sleeve that is a cylindrical member arranged around the rod-shaped member and rotating around the rod-shaped member and forms a magnetic brush by the developer drawn on a surface thereof are provided. As the tip of the magnetic brush formed on the developing sleeve of the developing unit 104K is in contact with the surface of the photosensitive body 101K, the black toner is attached to a portion on the surface of the photosensitive body 101K exposed by the exposing unit 103K, that is, an image line portion of the electrostatic latent image, and thus, the toner image is formed (developed) on the photosensitive body 101K. The developing units 104Y, 104M, and 104C are examples of a second developing unit of the invention.

The cylindrical roller 105K (an example of a first transfer device) faces the photosensitive body 101K with the transport path S being interposed therebetween. The roller 105K transfers the toner image formed on the surface of the photosensitive body 101K onto the sheet P transported to a gap between the photosensitive body 101K and the roller 105K. The rollers 105Y, 105M and 105C are examples of a second transfer device of the invention. The cleaning unit 106K removes the toner that remains on the surface of the photosensitive body 101K without being transferred to the sheet P.

The fixing device 20 (an example of a fixing device) fixes the toner image transferred onto the sheet P to the sheet P in the image forming device 10. The fixing device 20 includes a light generating section 21, a belt 22, a roller 23 and a roller 24 that are provided on the downstream side of the transport path S with reference to the image forming device 10. The belt 22 is an endless belt that transports the sheet P onto which the toner image is transferred to the downstream side of the transport path S. The belt 22 is wound over the roller 23 and the roller 24, and moves in a direction of arrow B by the roller 24 rotated by a motor (not shown), for example, to transport the sheet P.

Figure 2:
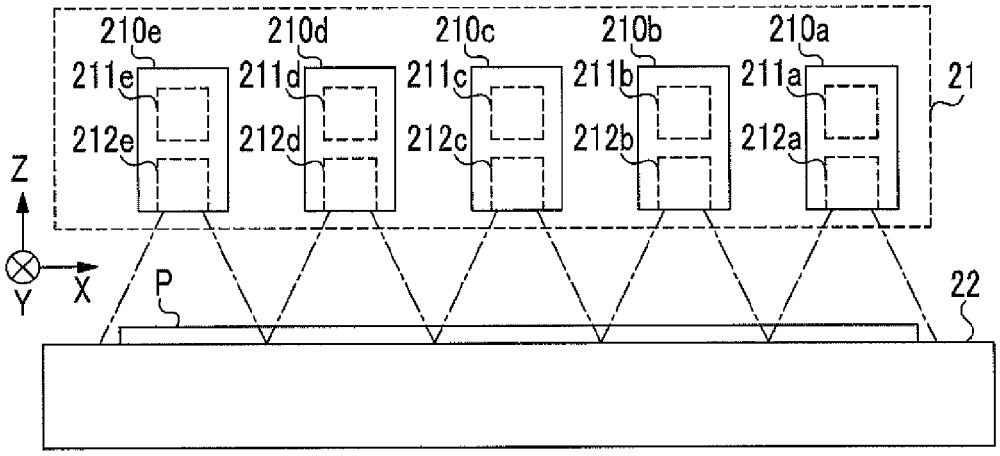
FIG. 2 is a diagram schematically illustrating a fixing device seen from an upstream side in a transport direction.

FIG. 2 is a diagram schematically illustrating the fixing device 20 seen from the upstream side in the transport direction. The light generating section 21 generates laser light for heating the toner transferred onto the sheet P, and is disposed at a position that faces the sheet P that is transported on the transport path S. The light generating section 21 includes emitting units 210*a* to 210*e*, and each emitting unit includes a light source 211 that generates laser light, and an emitting part 212 that emits the laser light generated by the light source 211 onto the sheet P. In FIG. 2, an alphabet (a, b, c, d or e) at the end of a reference numeral of the light sources and the emitting parts represents that the component corresponds to any one of the emitting units 210*a* to 210*e*. Each light source includes plural laser elements that generate laser light. Each emitting part includes one or plural optical components. Laser light generated in the light source 211*a* is diffused by an optical component of the emitting part 212*a* to be emitted toward the belt 22. With respect to the other light sources 211*b* to 211*e*, the generated laser light is diffused by the emitting part given the same alphabet as in the light source at the end of the reference numeral, and is emitted onto the belt 22.

The emitting units 210*a* to 210*e* are arranged in a line in a direction traverse to the transport direction along the front surface of the belt 22. Specifically, as illustrated in FIG. 2, in a case where Y axis is set in the transport direction of the sheet, X axis is set in a direction perpendicular to Y axis along the surface of the belt 22, and Z axis is set in a direction perpendicular to X axis and Y axis, the emitting units 210*a* to 210*e* are arranged in a line along the direction of X axis (width direction of the belt 22). The light source 211 emits light beams on the line in the paper width direction at constant emission intensity without differentiation in black and the other colors. In the present exemplary embodiment, the laser light emitted by the light source 211 oscillates in an IR (infrared) region of 800 to 1000 nm.

Returning to FIG. 1, the controller 50 includes a processor such as a Central Processing Unit (CPU), a Read Only Memory (ROM), and a Read Access Memory (RAM). A program executed by the processor is stored in the ROM. If the program is executed by the processor, an image forming function that forms an image on the sheet P according to an image received from the outside is realized. The operating section 52 includes various buttons for operation of the image forming apparatus 1. The controller 50 controls the respective units according to operations performed in the operating section 52.

The display section 54 includes a liquid crystal display device that is an example of a device that displays an image. The display section 54 is controlled by the controller 50 to display a menu screen for operation of the image display apparatus 1. The communicating section 53 includes a function of a communication interface that performs communication with an external computer device. The communicating section 53 receives image data sent from a different device such as a computer device, and supplies the received image data to the controller 50. The storage section 51 includes a memory, and stores the image data supplied to the controller 50.

Then, a configuration of the toner used in the developing unit 104 and a developing process performed by the developing unit 104 will be described. In the black toner used in the present exemplary embodiment, various ingredients such as a binder resin are included, and a pigment that absorbs visible light to infrared light such as carbon black or the like is added. On the other hand, in the color toner of yellow, magenta or cyan, an IR material that absorbs laser light is added, in addition to ingredients such as a binder resin or a color pigment. Since the IR material has a slight absorption in a visible region, the IR material is added to the color toner at a ratio that falls in a range where color cloudiness of the color toner is allowed.

In the present exemplary embodiment, the number of color toners per unit area on the surfaces of the photosensitive bodies 101Y, 101M and 101C is larger than the number of black toners per unit area, with respect to an image signal of the same coverage. Specifically, for example, the weight ratio of the color toner in the developer contained in each container of the developing units 104Y, 104M and 104C may be larger than the weight ratio of the black toner in the developer contained in the developing unit 104K. More specifically, for example, the controller 50 may perform control so that the amount of the color toner supplied to the developing units 104Y, 104M and 104C from each of the toner containers in which the color toner is contained is larger than the amount of the black toner. In the following description, for ease of description, in a case where it is not necessary to distinguish the developing units 104Y, 104M and 104C, these developing units are referred to as a "color developing unit 104CL". Similarly, in a case where it is not necessary to distinguish the photosensitive bodies 101Y, 101M and 101C, for ease of description, these photosensitive bodies are referred to as a "color photosensitive body 101CL".

Figure 3A:
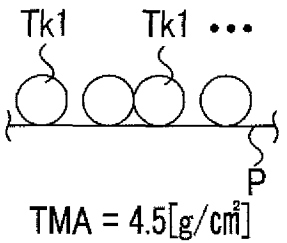
FIGS. 3A to 3C are diagrams illustrating a state where a layer of a toner transferred on a sheet is formed.
Figure 3B:
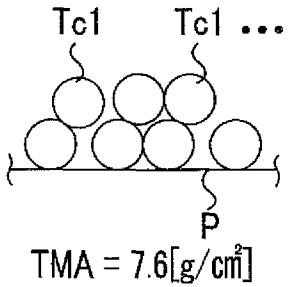
Figure 3C:
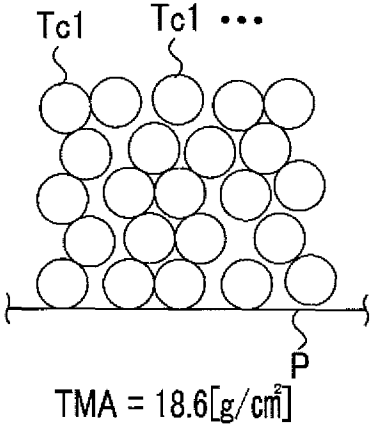
Figure 7A:
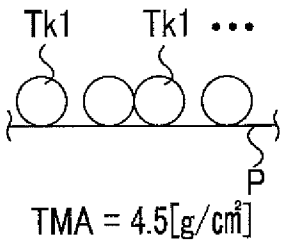
FIGS. 7A to 7C are diagrams illustrating a state where a layer of a toner transferred on a sheet is formed in an image forming apparatus in the related art.
Figure 7B:
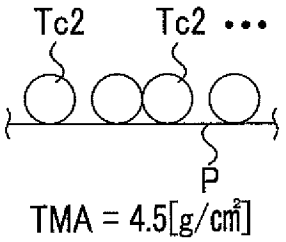
Figure 7C:
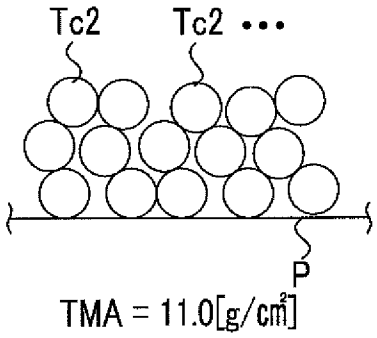

FIGS. 3A to 3C are diagrams schematically illustrating a state where the toner transferred onto the sheet P from the photosensitive body 101 forms a layer, and FIGS. 7A to 7C are diagrams illustrating an example of a state where a toner transferred onto a sheet forms a layer in an image forming apparatus in the related art. FIG. 3A is a diagram schematically illustrating a state where a black toner image is transferred onto the sheet P from the photosensitive body 101K, and FIG. 3B is a diagram schematically illustrating a state where single-color toner other than black is transferred onto the sheet P from the color photosensitive body 101CL. FIG. 3C is a diagram schematically illustrating a state where multi-color (that is, plural colors other than black) toner images are sequentially transferred onto the sheet P from the plural color photosensitive bodies 101CL. On the other hand, FIG. 7A is a diagram schematically illustrating a state where a black toner image is transferred onto a sheet from a black photosensitive body in the image forming apparatus in the related art, and FIG. 7B is a diagram schematically illustrating a state where single-color toner image is transferred onto a sheet from a photosensitive body in the image forming apparatus in the related art. Further, FIG. 7C is a diagram schematically illustrating a state where multi-color toner images are sequentially transferred onto a sheet from plural photosensitive bodies. In FIG. 3C, a state is shown where a toner image of which the toner weight per unit area is about 2.44 times a primary color is transferred onto the sheet.

As illustrated in FIG. 3A, in this measurement example, the amount of the toner per unit area in the black toner image formed by the developing unit 104K (hereinafter, referred to as "Toner Mass Area (TMA): g/cm$^2$") is set to 4.5 g/cm$^2$. The median diameter of the black toner used in the developing unit 104K (50% particle diameter, particle diameter corresponding to 50% of plus sieve distribution curve) is set to 5.8 μm.

On the other hand, as illustrated in FIG. 3B, in this measurement example, the amount of the toner per unit area (TMA) in the single-color toner image formed by each of the developing units 104Y, 104M and 104C is set to 7.6 g/cm$^2$. Further, as illustrated in FIG. 3C, the amount of the toner per unit area (TMA) in the multi-color toner image is set to 18.6 g/cm$^2$. The median diameter of the color toner used in each of the color developing unit 104CL is the same as the black toner used in the developing unit 104K, which is 5.8 μm.

As described above, since the median diameters of the black toner and the color toners are the same and the masses per particle of these toners are substantially the same, the number of toners per unit area in each toner image is increased in the order of the black toner, the single-color toner and the multi-color toner. As a result, as illustrated in FIGS. 3A to 3C, in the black toner image, the toners are arranged into a mono layer (single layer) on the sheet P, and in the single-color toner image, the toners are arranged into two layers on the sheet P, and in the multi-color toner image, the toners are arranged into five layers on the sheet P.

In the developing unit in the related art illustrated in FIGS. 7A to 7C, the same toner as the black toner used in the present exemplary embodiment is used as a black toner. That is, as the black toner, black toners Tk1, Tk1, . . . that use carbon black is used as a pigment and have a median diameter of 5.8 μm are used. In this measurement example, the amount of the toner per unit area (TMA) in the black toner images is set to 4.5 g/cm$^2$. On the other hand, with respect to the color toner, in this measurement example, color toners Tc2, Tc2, . . . that have a median diameter of 5.8 μm are used, and the TMA is set to 4.5 g/cm$^2$.

In the case of the example illustrated in FIGS. 7A to 7C, in the color toners Tc2, Tc2, . . . , an IR material is added at a level where color cloudiness is allowed. Specifically, a configuration is used in which a pigment of about 5% and an IR material of about 0.1% are included. In the color toners Tc2, Tc2, . . . , laser light is absorbed by the IR material, in which absorptivity is about 72%. Since the absorptivity of the black toner is 100%, although the laser light of the fixing device 20 has the same emission energy, fusing levels of the toners are different in black and the other colors, and thus, a large difference occurs in gloss of an image formed on the sheet P. Further, since the number of toners per unit area is large in the multi-color, the surface of the sheet is uniformly and easily filled with the fused toner, and thus, gloss close to that of an image formed by the black toner image is obtained. Thus, in the image forming apparatus in the related art illustrated in FIGS. 7A to 7C, a difference occurs between gloss of the black image or multi-color image and gloss of the primary color image, and thus, a fixed image with gloss unevenness as a whole is formed.

On the other hand, in the present exemplary embodiment, as illustrated in FIG. 3B, the TMA of the single-color toner image is set to be higher than the TMA of the black toner image. In the example illustrated in FIGS. 3A to 3C, although the absorptivity of the laser light of the single-color toner image is low compared with the image of the black toner, the TMA of the color toner image is higher than that of the image of the black toner. Thus, when the color toner is fused by the laser light of the fixing device 20, the surface of the sheet P is uniformly and easily filled. In this way, the gloss difference in the fixed images due to the absorptivity difference between the color toner and the black toner is modified by the TMA difference of the toner image, and as a result, in the image formed by the single-color toner image, gloss close to that of the image formed by the toner image of the black color is obtained. Thus, in the same emission energy, a fixed image with a small gloss difference is obtained in the respective black color, single-color and multi-color.

Figure 4:
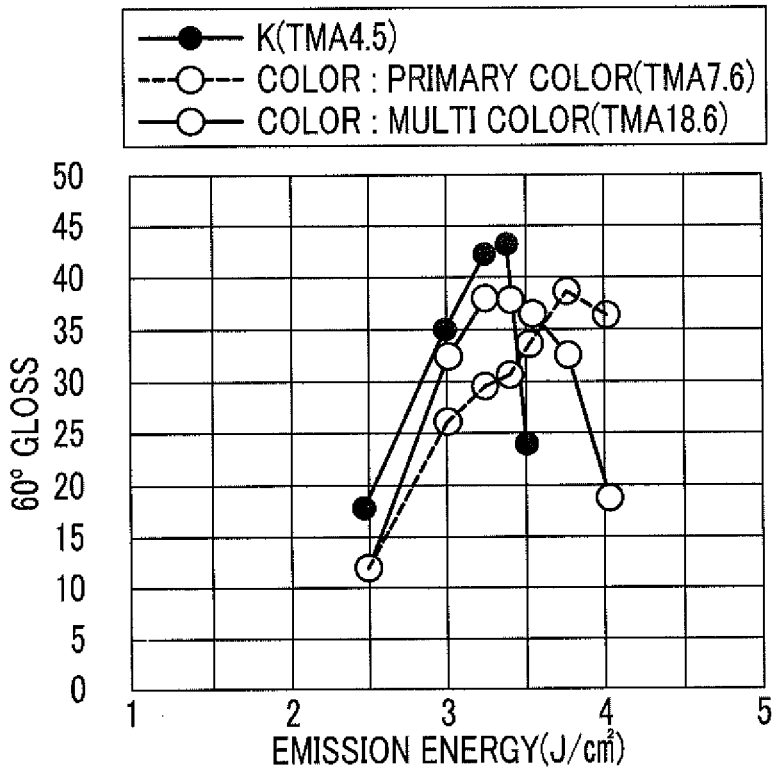
FIG. 4 is a diagram illustrating an example of a measurement result of emission energy and gloss of a fixing device.
Figure 8:
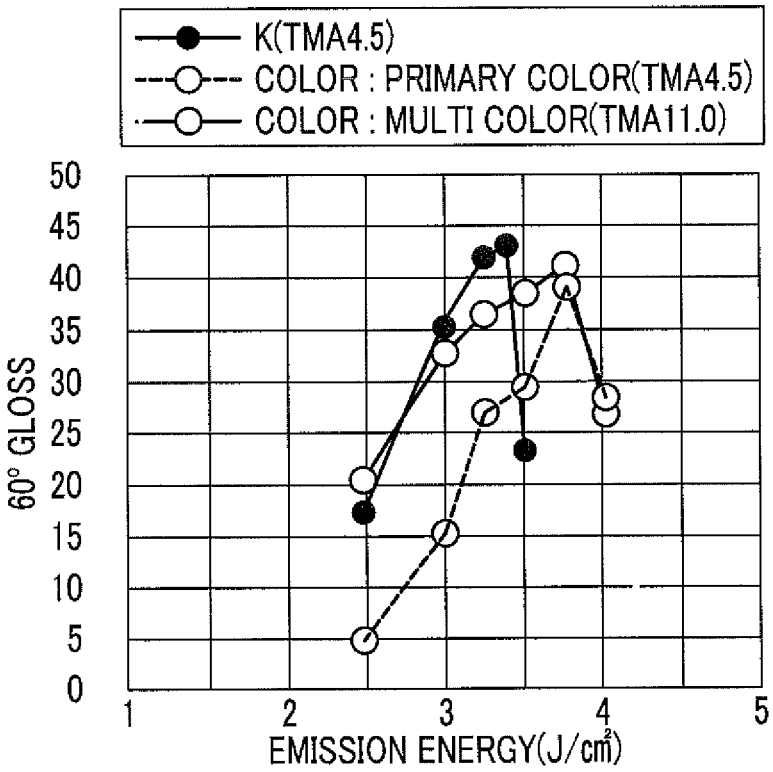
FIG. 8 is a diagram illustrating an example of the relationship between emission energy and gloss of a fixing device in an image forming apparatus in the related art.

FIG. 4 is a diagram illustrating an example of emission energy of laser light of the fixing device 20 and a measurement result of gloss of an image fixed to the sheet P. In FIG. 4, the transverse axis represents emission energy J/cm$^2$ of the laser light of the fixing device 20, and the longitudinal axis represents gloss. Further, FIG. 8 is a diagram illustrating an example of the relationship between emission energy of laser light of a fixing device in the related image forming apparatus and gloss of an image fixed to a sheet, in which the transverse axis represents emission energy J/cm$^2$ of the laser light of the fixing device, and the longitudinal axis represents gloss. As illustrated in FIG. 8, in the image forming apparatus in the related art, for example, if gloss is shown in an emission energy of 3.0 J/cm$^2$ is used, gloss of single-color is lower than gloss of black or multi-color, but in the present exemplary embodiment, as illustrated in FIG. 4, the gloss difference in single-color (primary color), multi-color and black is decreased.

Incidentally, the TMA of the color toners Tc1, Tc1, . . . used in the present exemplary embodiment is 7.6 g/cm$^2$, which is about 1.7 times 4.5 g/cm$^2$ that is the TMA of the black toners Tk1, Tk1, . . . , but the ratio of the pigment and the IR material of the color toners Tc1, Tc1, . . . is 0.6 (1/1.7) times that of the related color toners Tc2, Tc2, . . . . That is, in the present exemplary embodiment, the addition concentration of the color pigment and the IR material in the color toner is low compared with the related color toners. Thus, the amount of the pigment and the IR material per unit area in the color toner image has the same value in the present exemplary embodiment (FIG. 3B) and the related art (FIG. 7B). Thus, in the present exemplary embodiment, the number of toners per unit area in the color toner image is large compared with the related image forming apparatus, and the color of the image formed by the color toner image is not deep in color.

Operation

Then, the operation of the image forming apparatus 1 will be described. If an image processing is instructed from a different computer device or is instructed as the operating section 52 is operated by the user, the image forming apparatus 1 performs various image processings according to the instructed content. In a case where an image forming process is instructed, the image forming device 10 exposes the photosensitive body 101 by the exposing unit 103 according to supplied image data to form an electrostatic latent image, and develops a toner image by the developing unit 104 according to the electrostatic latent image, and then, transfers the toner image onto the sheet P, under the control of the controller 50.

At this time, the developing unit 104 moves a toner charged with a polarity opposite to that of the electrostatic latent image to the electrostatic latent image formed on the surface of the photosensitive body 101 to form the toner image on the photosensitive body 101. Here, the number of toners per unit area moved to the surface of the photosensitive body 101 correlates with the exposure in the exposing unit 103 and the toner ratio of the toner in the developer accommodated in the developing unit 104. More specifically, the number of toners per unit area moved to the surface of the photosensitive body 101 is increased as the exposure in the exposing unit 103 is increased, and is increased as the ratio of the toner in the developer accommodated in the developing unit 104 is increased. In the present exemplary embodiment, since the ratio of the color toner in the developer is increased compared with that of the black toner, the number of toners per unit area moved to the surface of the photosensitive body 101 is increased in the case of the color toner, compared with the case of the black toner.

The toner images developed by the respective developing units 104Y, 104M, 104C and 104K are transferred onto the sheet P by the rollers 105Y, 105M, 105C and 105K, and the toners are fused on the sheet P by laser light emitted from the fixing device 20 to be fixed to the sheet P. At this time, as described above, since the number of color toners per unit area on the sheet P is larger than that of the black toner, the surface of the sheet P is uniformly and easily filled in the case of the color toner. Thus, gloss of the image formed by the color toner is increased, and as a result, gloss unevenness of an image formed by the black toner image and an image formed by the single-color toner image is suppressed. That is, in the present exemplary embodiment, the black toner attached to the sheet P forms a mono layer, and the color toner forms a layer other than black. Thus, the color toner uniformly covers the surface of the sheet P compared with the black toner, and thus, a laser light absorptivity difference between the black toner and the color toner is corrected, which results in suppression of the gloss unevenness.

In the above-described exemplary embodiment, the fixing device 20 employs a configuration in which the fixing of the toner image is performed by the laser fixing method, but a different light fixing method such as a flash fixing method or an LED fixing method may be employed in the fixing device 20. Further, a fixing device in which the fixing is performed by receiving heat generated from a heat generator in a non-contact state for fixing may be employed. However, in the laser fixing method in which toner fixity or gloss significantly depends on the light absorptivity compared with the TMA, the invention is particularly efficient.

Second Exemplary Embodiment

Next, another exemplary embodiment of the invention will be described. An image forming apparatus (hereinafter, referred to as a "image forming apparatus 1A") according to the present exemplary embodiment is different from the image forming apparatus 1 according to the first exemplary embodiment in that a toner having a median diameter smaller than that of the black toner is used as a color toner, and the ratio of a pigment included in the color toner is high compared with the color toner used in the first exemplary embodiment, and is the same as in the first exemplary embodiment with respect to the other components or processes. Thus, in the following description, different points of the second exemplary embodiments from the first exemplary embodiment will be mainly described. In addition, the same reference numerals are given to the same components as the components in the image forming apparatus 1 according to the first exemplary embodiment, among components of the image forming apparatus 1A according to the second exemplary embodiment.

Figure 5A:
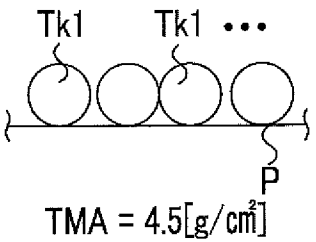
FIGS. 5A to 5C are diagrams illustrating a state where a layer of a toner transferred on a sheet is formed.
Figure 5B:
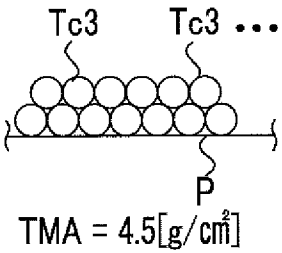
Figure 5C:
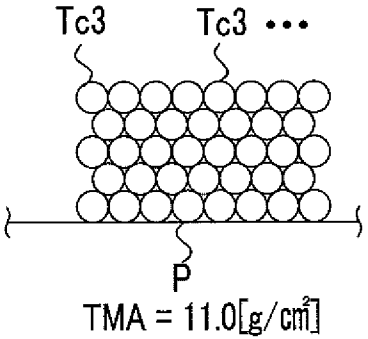

FIGS. 5A to 5C are diagrams schematically illustrating a state where a layer of a toner transferred onto the sheet P from the photosensitive body 101 in the present exemplary embodiment is formed, which correspond to FIGS. 3A to 3C in the above-described first exemplary embodiment. FIG. 5A is a diagram schematically illustrating a state where a toner image of a black color is transferred onto the sheet P from the photosensitive body 101K, and FIG. 5B is a diagram schematically illustrating a state where a toner image of a primary color (single-color) is transferred onto the sheet P from the color photosensitive body 101CL. FIG. 5C is a diagram schematically illustrating a state where toner images of multi-colors (that is, plural colors other than black) are sequentially transferred onto the sheet P from the plural color photosensitive bodies 101CL.

In the present exemplary embodiment, the median diameter of the black toner is 5.8 μm. That is, the same black toner as in the first exemplary embodiment is used. On the other hand, as the color toner, a color toner that has a median diameter of 4.6 μm smaller than that of the color toner in the first exemplary embodiment is used. Further, in the first exemplary embodiment, the ratio of the pigment in the color toner is set to about 0.6 times that in the general color toner, but in the present exemplary embodiment, the color toner employs a pigment having the same ratio as the ratio of the pigment in the general color toner.

As is obvious from comparison of FIGS. 5A and 5B, the TMA that forms the toner image of the primary color is maintained while reducing in size the color toner compared with the black toner, the number of toners per unit area in the toner images of the primary color is increased compared with the black toner. As the toner having a small median diameter is used, the color toner sufficiently covers the surface of the sheet, and thus, the surface of the sheet is uniformly and easily filled. Thus, gloss of an image formed by the single-color toner image is increased, and thus, a difference with gloss of an image formed by the black toner image is decreased, thereby suppressing gloss unevenness in the fixed image. Further, in the present exemplary embodiment, since the TMA of the black toner and the TMA of the single-color toner are the same, a necessary toner amount (amount of resin and the like except a pigment) is not increased. Further, a problem such as disturbance of an image due to increase in a total necessary toner amount does not occur.

Figure 6:
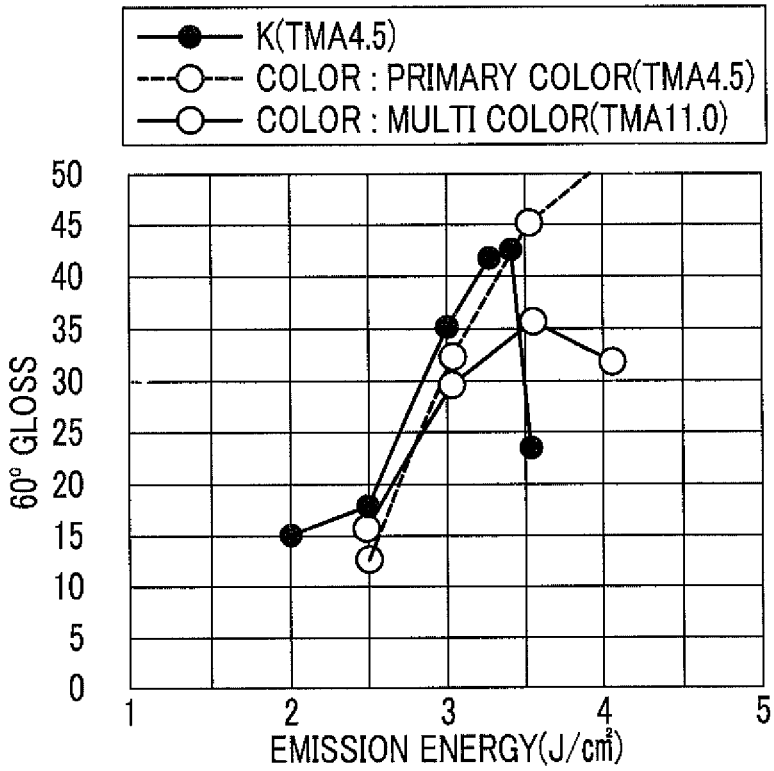
FIG. 6 is a diagram illustrating an example of a measurement result of emission energy and gloss of a fixing device.

FIG. 6 is a diagram illustrating an example of a measurement result of emission energy of the laser light and gloss of a toner image fixed to the sheet P of the fixing device 20 in the present exemplary embodiment, which corresponds to FIG. 4 in the above-described exemplary embodiment. In FIG. 6, the transverse axis represents emission energy of laser light of the fixing device 20, and the longitudinal axis represents gloss. As illustrated in FIG. 6, in the present exemplary embodiment, a difference between glosses of single-color, black and multi-color is decreased in a region where emission energy is 2.5 to 3.0 J/cm$^2$, for example.

Modification Examples

Hereinbefore, the exemplary embodiments of the invention have been described, but the invention is not limited to the above-described exemplary embodiments, and may be used in various forms. Examples thereof are as follows. Combinations of the following various examples may be used.

(1) In the above-described exemplary embodiments, the respective color toners of yellow, magenta and cyan are used as the color toner, but the type of the color toner is not limited thereto, and different color toners may be used. That is, it is sufficient if the number of color toners per unit area moved to the sheet P is large compared with the number of black toners.

(2) In the above-described exemplary embodiments, as the ratio of the amount of the toner in the developer with respect to the color toner is high compared with that of the black toner, the number of color toners per unit area attached to the sheet P is larger than the number of black toners, with respect to an image signal with the same coverage, but the invention is not limited to this configuration. That is, any different configuration may be used in which the number of color toners per unit area is larger than the number of black toners. For example, the light intensity when the exposing units 103Y, 103M and 103C perform exposure may be higher than the light intensity when the exposing unit 103K performs exposure. Further, as another example, a bias voltage for development may be changed, for example, so that the number of color toners per unit area is larger than the number of black toners. Further, as another example, externally added ingredients of the toners or materials of the carries may be changed, for example, so that the charging of the toner may be different in the color toner and the black toner.

(3) In the above-described exemplary embodiments, the black toner is used as the mono layer (that is, the number of layers is 1), but the number of layers is not limited thereto, and may have a different value. It is preferable that the number of layers of the color toner be a value larger than the number of layers of the black toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be definitely by the following claims and their equivalents.

What is claimed is:

1. A toner image forming device comprising:

a first toner image forming section including a charged first image holding member, a first exposing unit that emits light onto the first image holding member to form a latent image on the first image holding member, and a first developing unit that develops the latent image formed on a surface of the first image holding member by a black toner to form a toner image;

a second toner image forming section including a charged second image holding member, a second exposing unit that emits light onto the second image holding member to form a latent image on the second image holding member, and a second developing unit that develops the latent image formed on a surface of the second image holding member by a toner of each single color other than black to form a toner image; and a controller that performs control so that the number of toner particles that the second toner image forming section uses per unit area with respect to an image signal of a first coverage is larger than the number of toner particles that the first toner image forming section uses per unit area with respect to the image signal of the first coverage.

2. The toner image forming device according to claim 1, wherein the controller performs control so that a part of the toners in the toner image formed by the second toner image forming section are stacked on the other part thereof.

3. The toner image forming device according to claim 2, wherein the first developing unit includes a first developer being mixed with a magnetic carrier and the black toner, wherein the second developing unit includes a second developer being mixed with a magnetic carrier and the toner of color other than black, and wherein the weight ratio of the toner of color other than black in the second developer is larger than the weight ratio of the black toner in the first developer.

4. The toner image forming device according to claim 3, wherein the median diameter of the toner of color other than black is smaller than the median diameter of the black toner.

5. The toner image forming device according to claim 4, wherein an exposure light intensity of the light emitted by the second exposing unit to form the toner image is larger than an exposure light intensity of the light emitted by the first exposing unit to form the toner image.

6. The toner image forming device according to claim 3, wherein an exposure light intensity of the light emitted by the second exposing unit to form the toner image is larger than an exposure light intensity of the light emitted by the first exposing unit to form the toner image.

7. The toner image forming device according to claim 2, wherein the median diameter of the toner of color other than black is smaller than the median diameter of the black toner.

8. The toner image forming device according to claim 7, wherein an exposure light intensity of the light emitted by the second exposing unit to form the toner image is larger than an exposure light intensity of the light emitted by the first exposing unit to form the toner image.

9. The toner image forming device according to claim 2, wherein an exposure light intensity of the light emitted by the second exposing unit to form the toner image is larger than an exposure light intensity of the light emitted by the first exposing unit to form the toner image.

10. An image forming apparatus comprising:
the toner image forming device according to claim 2;
a first transfer device that transfers the toner image formed by the first toner image forming section from the first image holding member onto a recording medium;
a second transfer device that transfers the toner image formed by the second toner image forming section from the second image holding member onto the recording medium; and
a fixing device that fixes the toner image transferred onto the recording medium by the first transfer device and the toner image transferred onto the recording medium by the second transfer device, in a non-contact manner.

11. The image forming apparatus according to claim 10, wherein the fixing device includes an emitting section for emitting laser light.

12. The toner image forming device according to claim 1, wherein the first developing unit includes a first developer being mixed with a magnetic carrier and the black toner, wherein the second developing unit includes a second developer being mixed with a magnetic carrier and the toner of color other than black, and
wherein the weight ratio of the toner of color other than black in the second developer is larger than the weight ratio of the black toner in the first developer.

13. The toner image forming device according to claim 12, wherein the median diameter of the toner of color other than black is smaller than the median diameter of the black toner.

14. The toner image forming device according to claim 13, wherein an exposure light intensity of the light emitted by the second exposing unit to form the toner image is larger than an exposure light intensity of the light emitted by the first exposing unit to form the toner image.

15. The toner image forming device according to claim 12, wherein an exposure light intensity of the light emitted by the second exposing unit to form the toner image is larger than an exposure light intensity of the light emitted by the first exposing unit to form the toner image.

16. The toner image forming device according to claim 1, wherein the median diameter of the toner of color other than black is smaller than the median diameter of the black toner.

17. The toner image forming device according to claim 16, wherein an exposure light intensity of the light emitted by the second exposing unit to form the toner image is larger than an exposure light intensity of the light emitted by the first exposing unit to form the toner image.

18. The toner image forming device according to claim 1, wherein an exposure light intensity of the light emitted by the second exposing unit to form the toner image is larger than an exposure light intensity of the light emitted by the first exposing unit to form the toner image.

19. An image forming apparatus comprising:
the toner image forming device according to claim 1;
a first transfer device that transfers the toner image formed by the first toner image forming section from the first image holding member onto a recording medium;
a second transfer device that transfers the toner image formed by the second toner image forming section from the second image holding member onto the recording medium; and
a fixing device that fixes the toner image transferred onto the recording medium by the first transfer device and the toner image transferred onto the recording medium by the second transfer device, in a non-contact manner.

20. The image forming apparatus according to claim 19, wherein the fixing device includes an emitting section for emitting laser light.

* * * * *